US010407849B1

(12) United States Patent
Matthews et al.

(10) Patent No.: US 10,407,849 B1
(45) Date of Patent: Sep. 10, 2019

(54) VEHICLE TO RECLAIM MILLED ROAD SURFACE AGGREGATE FOR REUSE AS A ROAD SURFACE

(71) Applicant: Pavement Recycling Systems Inc., Jurupa Valley, CA (US)

(72) Inventors: Donald M Matthews, Jurupa Valley, CA (US); Stephen Concannon, Jurupa Valley, CA (US); Richard Gove, Riverside, CA (US); Jorge A Campos, Jurupa Valley, CA (US)

( * ) Notice: Subject to any disclaimer, the term of this patent is extended or adjusted under 35 U.S.C. 154(b) by 0 days.

(21) Appl. No.: 15/921,607

(22) Filed: Mar. 14, 2018

(51) Int. Cl.
*E01C 19/00* (2006.01)
*E01C 23/06* (2006.01)

(52) U.S. Cl.
CPC ..... *E01C 23/065* (2013.01); *E01C 19/002* (2013.01)

(58) Field of Classification Search
CPC ..... E01C 23/065; E01C 19/002
USPC ..... 404/81, 84.05, 90, 91, 101
See application file for complete search history.

(56) References Cited

U.S. PATENT DOCUMENTS 4,185,875 A * 1/1980 Swisher, Jr. ..... B02C 4/26 241/101.762
4,272,212 A 6/1981 Bauer et al.
4,347,016 A 8/1982 Sindelar et al.
4,676,688 A * 6/1987 Caradot ..... E01C 19/466 198/308.1
4,818,139 A 4/1989 Brock et al.
4,944,631 A 7/1990 Egli
4,946,307 A * 8/1990 Jakob ..... E01C 23/065 404/90
4,974,993 A * 12/1990 Crabbi ..... E01C 7/187 404/75
5,026,206 A * 6/1991 O'Connor ..... E01C 19/025 404/77
5,219,450 A 6/1993 Thurk
5,251,999 A 10/1993 McCracken
5,735,952 A * 4/1998 Wilson, Sr. ..... E01C 19/16 118/100
5,741,085 A * 4/1998 Wirtgen ..... E01C 23/065 404/75
5,762,446 A * 6/1998 Manatt ..... B02C 21/02 241/101.74
5,938,373 A * 8/1999 Scudder ..... E02F 5/226 241/101.74
5,988,937 A * 11/1999 Komoriya ..... E02D 3/12 241/101.74
6,183,159 B1 * 2/2001 Hashimoto ..... E02F 5/226 404/76
6,220,782 B1 * 4/2001 Yates ..... E01C 23/065 404/75

(Continued)

*Primary Examiner* — Raymond W Addie
(74) *Attorney, Agent, or Firm* — Kenneth Avila

(57) ABSTRACT

There is provided a three vehicle train for the continuous cold in-place recycling of asphalt road surface, the train comprising a first supply vehicle containing both water and asphalt emulsion that is in fluid communication with the remaining vehicles; a second milling vehicle for removing a portion of the topmost layer of the road surface as aggregate and evacuating the aggregate via a system of conveyors to a third vehicle; and a third processing vehicle for screening the aggregate to a proper size, mixing the aggregate with cement, water, and/or asphalt emulsion under computer control into a slurry, and depositing the resulting slurry onto the previously milled asphalt road surface.

9 Claims, 12 Drawing Sheets

(56) References Cited

U.S. PATENT DOCUMENTS

| | | | | |
|---|---|---|---|---|
| 6,398,453 | B1 | 6/2002 | Stegemoeller | |
| 6,439,804 | B1 | 8/2002 | Crupi | |
| 7,134,806 | B2 | 11/2006 | Lazic | |
| 7,909,534 | B1 * | 3/2011 | Comer | E01C 19/42 404/118 |
| 2002/0044828 | A1 * | 4/2002 | Olynyk | B02C 21/026 404/72 |
| 2007/0131807 | A1 * | 6/2007 | Umeda | B02C 18/2225 241/34 |
| 2010/0316445 | A1 * | 12/2010 | Kasahara | E01C 23/065 404/77 |
| 2012/0070228 | A1 * | 3/2012 | Gorman | E01C 23/065 404/75 |
| 2013/0189032 | A1 | 7/2013 | Bellerose et al. | |
| 2015/0354150 | A1 * | 12/2015 | Dahm | E01C 19/4886 404/84.05 |

* cited by examiner

VEHICLE TO RECLAIM MILLED ROAD SURFACE AGGREGATE FOR REUSE AS A ROAD SURFACE

BACKGROUND OF THE INVENTION

1. Field of the Invention

The invention relates to a system for cold in-place recycling of pavement, more specifically to a material management system for continuous cold in-place recycling of pavement comprised of three vehicles of which one vehicle is of a new design and to an improved method of performing the cold in-place recycling of pavement. Cold in-place recycling of pavement allows for the effective maintenance and repairing of uneven areas and cracks in road surfaces.

2. Description of the Related Art

The repair and maintenance of road surfaces are important duties of various governmental bodies extending from local municipalities to federal departments of transportation. Constant attention must be given to the condition of road surfaces as the presence of water, continual passage of vehicles of varying weight, earth movement, hot and cold weather extremes, and more, damages the surface of the road creating cracks, uneven surfaces, and the such which if left unattended may severely damage the underlying road base or create road hazards for motorists. The enormous number and variety of paved roads makes it difficult for federal, state, and local municipalities to implement repairs in a timely, cost effective, and safe manner. In addition to the causes above, asphalt road surfaces are typically laid in passes by a paving machine and cracks perpendicular to the abutment of the passes commonly develop as a result of thermal expansion and contraction due to weather extremes. These lateral cracks are constantly being impacted by a vehicle's tires; damaging the tires and causing further damage to the road surface.

A common approach to repairing a road surface that shows a low amount of distress is referred to as "microsurfacing". Microsurfacing involves treating the distressed asphalt road surface with a slurry comprised of the ingredients water, asphalt emulsion, aggregate (small crushed rock), and chemical additives such as Portland cement ("cement") in ratios determined previously for the road surface to be treated. The asphalt emulsion used in microsurfacing contains chemical additives which allow the slurry to "break" or harden without relying on the sun or heat for evaporation to occur. This allows the road surface to quickly return to service even in cold or damp environments. The process generally involves thoroughly cleaning the road surface to be treated as well as sealing tight cracks and filling wide cracks. A milling machine may be utilized to mill off a small layer off the top of the road surface to improve bonding with the slurry. After the road surface has been prepared, the slurry may be dispensed on top of the road surface by one of two means. The first means is a self-propelled vehicle designed for such a purpose containing tanks that hold the individual slurry ingredients, mechanisms controlled by a computer to mix the ingredients in the proper ratios, and a method to dispense the slurry onto the road surface being treated. The second means comprises a "train" of two vehicles wherein the first vehicle is a self-propelled supply truck that pulls a second vehicle that mixes the ingredients in proper ratios to create and dispense the slurry. In both cases, the slurry formed by the mixed ingredients is poured into a rectangular cuboid device enclosed about its sides called a "spreader box". The spreader box rides above the road surface using skids mounted to its left and right sides. The gap between the road surface and the front, left, and right sides of the spreader box are filled by a curtain, typically rubber, while the gap between the road surface and the rear side of the spreader box is left open. Within the spreader box augers are employed to ensure an equal distribution of the slurry throughout the spreader box. As the spreader box moves forward over the road surface, the slurry is poured into the spreader box and pass onto the road surface via the gap found on the rear side. A flexible screed made from rubber or fabric may be attached to the rear of the spreader box to further remove any irregularities from the surface of the slurry. The primary advantage of using a single vehicle is that it is very difficult when using multiple vehicles in a train to maneuver about curves in a road or in cul-de-sacs. A disadvantage of using a single vehicle is that its internal supply of ingredients to form the slurry quickly diminish thus requiring the vehicle to leave the job site, travel to a "pit stop" location where it may be replenished with the required ingredients, and then returning to the job site. Care must be taken by the operators when stopping and subsequently restarting treatment of the road surface so that irregularities in the road surface do not appear. These characteristics are reversed when using a train of multiple vehicles. Using a supply truck allows for larger areas of road surfaces to be resurfaced. In addition, the process may be considered continuous as a depleted supply truck may be quickly replaced by a waiting loaded supply truck. However, when using a train of multiple vehicles, it is not possible to resurface roads containing a high rate of curvature or cul-de-sacs. Regardless of the means used for microsurfacing the process should only be used to treat road surfaces that exhibit a small amount of distress such as smaller cracks and slight unevenness of the road surface. For roads showing moderate to large levels of distress such as larger cracks, pot holes, and uneven surfaces microsurfacing is not an appropriate choice of treatment.

A common approach to repairing a road surface that shows higher amounts of distress is referred to as "cold in-place recycling" (CIR). This approach involves grinding off the top 2 to 5 inches of the existing asphalt surface, mixing the grounded asphalt with an asphalt emulsion and water, and finally dispensing the resultant mixture on the road surface as a single process. The CIR process is typically performed using two trains of vehicles which customarily includes in the first train a supply vehicle containing water, a milling vehicle to grind off the distressed layer of road surface, a processing vehicle to process and reclaim the asphalt removed by the milling vehicle, and a second supply truck containing asphalt emulsion for the processing vehicle. The resulting mix is deposited on the road surface as a windrow and not a slurry as with microsurfacing. A second train consists of two vehicles that are not linked to each other as the vehicles in the first train but work closely together. Comprising the second train is a first vehicle, referred to as a windrow elevator, that picks up the mix from the road surface and deposits the mix onto the second vehicle, referred to as a paver, which will spread the mix evenly across the road surface. Following the second train steel and rubber wheeled rollers pass repeatedly over the new road surface to compact the mix. Finally, a fog seal is applied to the new road surface to further postpone the appearance of distress cracks and other unwanted road conditions. The primary advantage of CIR over microsurfacing is that roads showing a greater level of distress may be restored as a significant portion of the topmost layer of the road surface is treated. Another advantage of CIP over microsurfacing is that the road surface milled by the milling vehicle is recycled and returned back to the road surface as part of a self-contained process thereby eliminating the need for the microsurfacing vehicle to resupply itself with aggregate or for supply trucks carrying aggregate from and to the job site. However, the expense and number of specialized equipment needed results in costs that far exceed that of microsurfacing.

What is needed is a new class of vehicles that will support a process that incorporates the recycling and performance advantages found with CIR with the simplicity of microsurfacing. The new process will mill the distressed top surface of the road surface as aggregate, screen and process the aggregate to reclaim it, convert the aggregate to a slurry and dispense the slurry using a spreader box as in microsurfacing projects. New vehicles would need to be developed that would combine operations of vehicles in the CIR trains. The end result will be a process that will be as environmentally friendly as CIR, with cost effectiveness approaching microsurfacing, minimizing the impact on traffic as with microsurfacing, improvement on ride quality approaching CIR, and the depth of road surface treatment approaching CIR.

BRIEF SUMMARY OF THE INVENTION

The invention described herein is for a train that will mill a smaller subset of the road surface than traditional CIR systems as aggregate; process the milled aggregate so that it is of the proper size to be reused onto the road surface; mix the aggregate with water, asphalt emulsion, and cement to form a slurry; and then deposit the slurry onto the road surface using a spreader box. The train may operate continuously, that is there is no need to stop for longer periods of time in order to replenish any depleted aggregate. The asphalt emulsion will break quickly, allowing the slurry to harden promptly and keep traffic disruption at a minimum.

It is an object of the invention for the train to be kept at three vehicles. A first vehicle being a supply vehicle carrying water and asphalt emulsion to supply the remaining vehicles with the same, a second vehicle to mill the top portion of the road surface into an aggregate, and a third vehicle to process the aggregate into a slurry suitable to be placed back onto the road surface. The train being able to operate continuously.

It is another object of the present invention for the third vehicle to receive water, asphalt emulsion, and aggregate from external sources into local storage tanks while simultaneously removing water, asphalt emulsion, and aggregate from these local storage tanks to create a slurry capable of being deposited onto a road surface for treatment of the road surface.

It is yet another object of the present invention for the third vehicle to screen aggregate being received so that oversized aggregate is crushed and subsequently recombined with acceptably sized aggregate.

It is yet another object of the present invention for the third vehicle to continuously adjust the amounts of water, asphalt emulsion, and cement added to the aggregate based upon the weight of the aggregate available at that present moment for mixing.

It is yet another object of the present invention to utilize a spreader box containing augers to maintain a equal distribution of the slurry throughout the spreader box and a metal strike plate attached to its rear side with vibrators to uniformly disperse the slurry onto the road surface while compacting the slurry so that aggregate does not protrude above the road surface.

In order to facilitate an understanding of the invention, the preferred embodiments of the invention are illustrated in the drawings, and a detailed description thereof follows. It is not intended, however, that the invention be limited to the particular embodiments described or illustrated herein. Various modifications and alternative embodiments such as would ordinarily occur to one skilled in the art to which the invention relates are also contemplated and included within the scope of the invention described and claimed herein.

BRIEF DESCRIPTION OF DRAWINGS

The present invention will become more fully understood from the detailed description and accompanying drawings, wherein.

DEFINITIONS

Technical terms used in this disclosure have the meanings that are commonly recognized by those skilled in the art. However, the following terms may have additional meanings, as described below.

The term "road surface", as used herein, refers to the topmost layer of material used in the construction of roads where asphalt is used as a binder for gravel or crushed stone.

The term "aggregate", as used herein, refers to material that has been removed from the road surface to be screened for oversized material, mixed with additives, and subsequently returned to the road surface it was removed from as a continuous process to establish a new road surface.

The term "emulsion", as used herein, is a stable dispersion of asphalt cement droplets in water that is mixed with aggregate and acts bind the aggregate.

The term "slurry", as used herein, refers to a mixture of aggregate, cement, water, and emulsion in certain ratios best suited for the road surface where it is to be applied.

The term "break", as used herein when referring to slurry, refers to the amount of time required for the water component of the emulsion to evaporate from the slurry allowing traffic to pass on the treated road surface.

The term "computer", as used herein, refers to a computational device that may receive information from multiple inputs, perform calculations and make decisions from those inputs, and send information to multiple outputs all simultaneously.

The term "recipe", as used herein, refers to particular ratios of emulsion, cement, and/or water as to aggregate that allow the aggregate to be reused as a road surface.

DETAILED DESCRIPTION OF THE INVENTION

Figure 1:
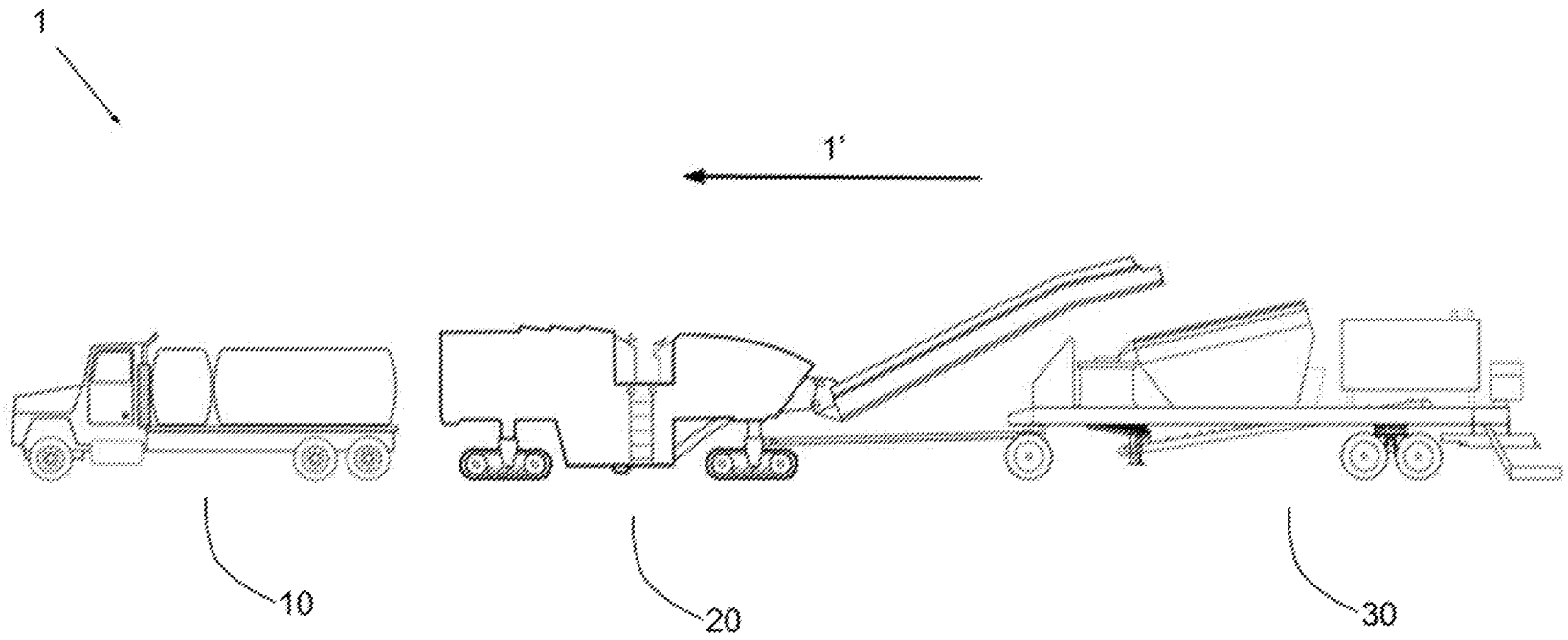
FIG. 1 shows a side elevation view of the train of the present invention.
Figure 3:
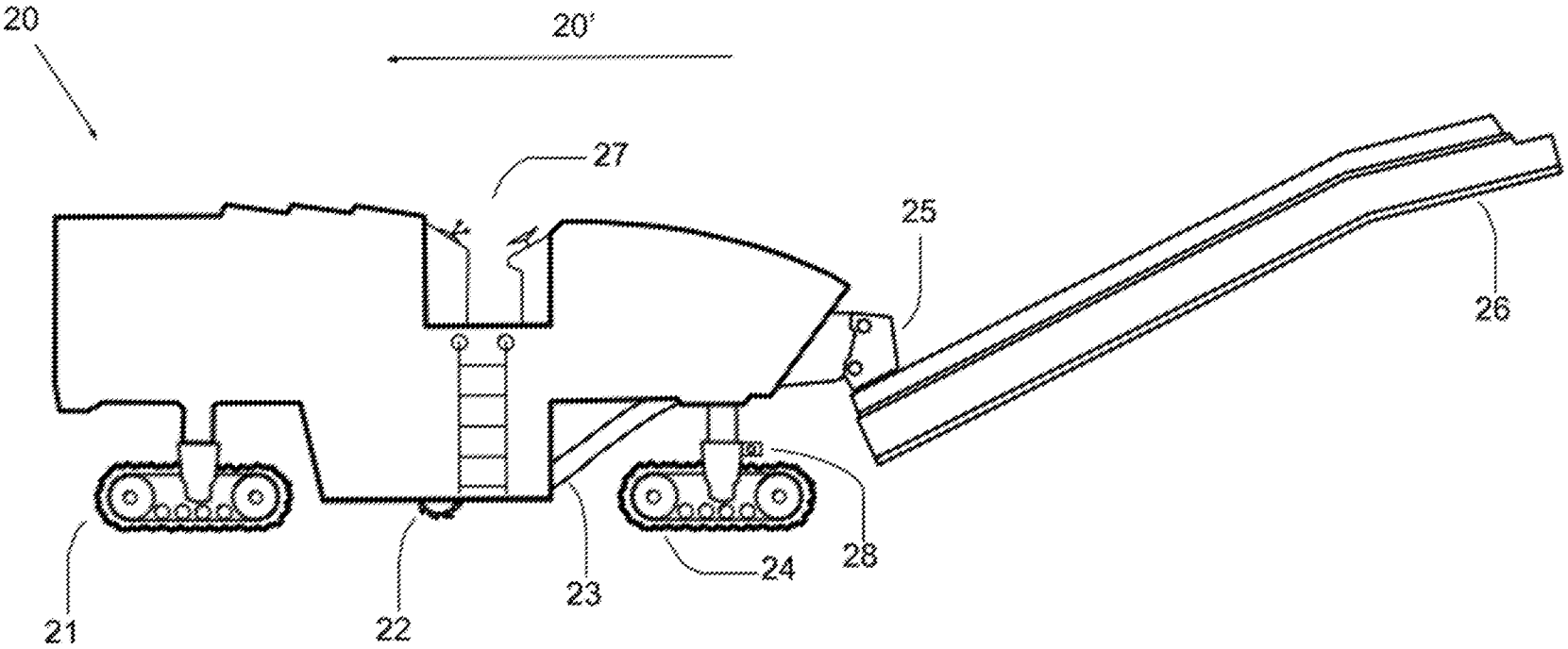
FIG. 3 shows a side elevation view of the milling vehicle of the present invention.

FIG. 1 shows train 1 of the present invention containing supply vehicle 10, milling vehicle 20, and processing vehicle 30 with supply vehicle 10 leading train 1 in the direction of forward movement indicated by 1'. Supply vehicle 10 is loosely connected to milling vehicle 20 and processing vehicle 30 by hoses, not shown in FIG. 1, to provide a source of water and emulsion to the remaining vehicles in train 1. Milling vehicle 20 is self-propelled and is joined to and tows processing vehicle 30 behind it. In operation, as train 1 moves forward, milling machine 20 will begin rotating cutting drum 22, shown in FIG. 3, to remove a portion of the road surface as aggregate. Via a system of conveyors, the aggregate is transported from milling vehicle 10 to processing vehicle 30 where the aggregate screened for size, mixed with additives, and deposited back onto the road surface. Emulsifiers added to the aggregate by processing vehicle 30 allow the road surface to be available for traffic shortly thereafter.

Figure 2:
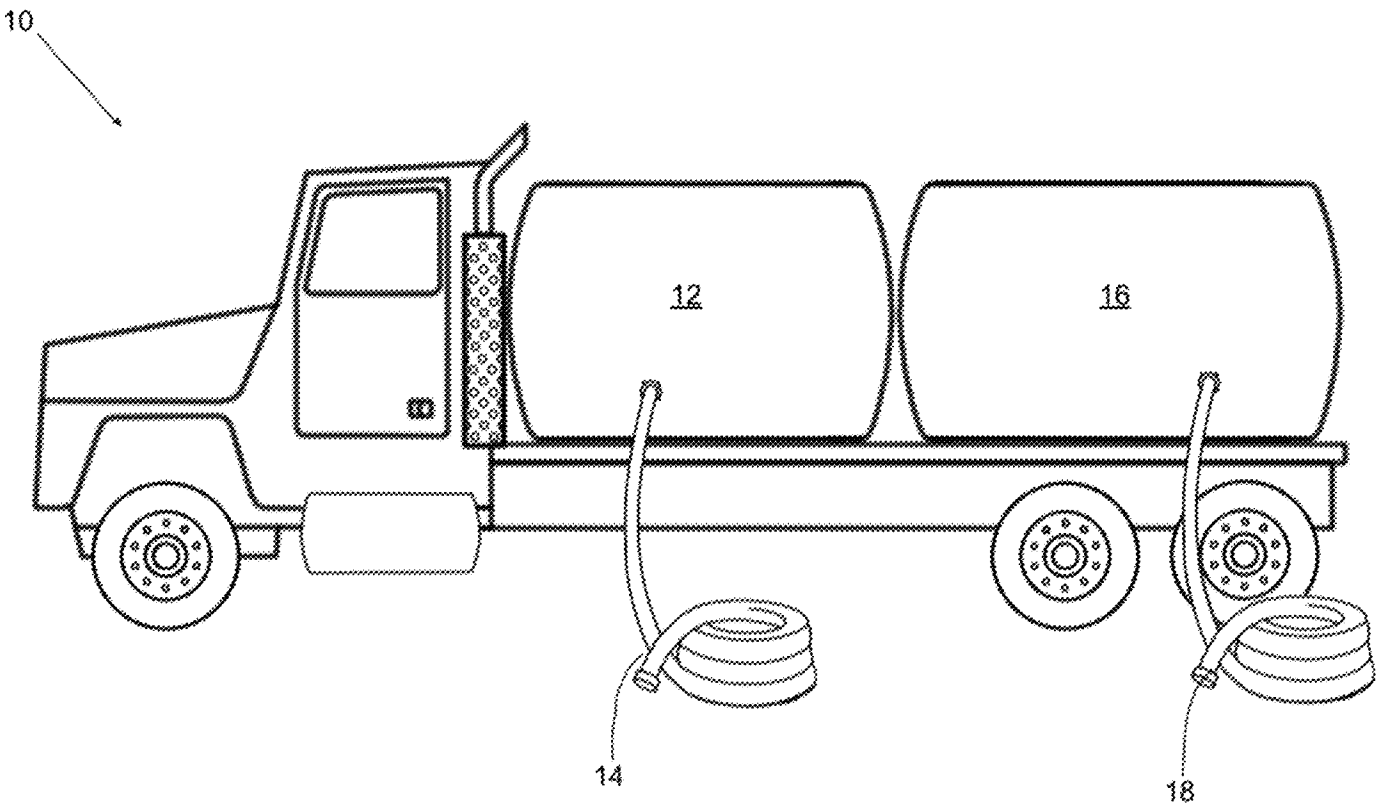
FIG. 2 shows a side elevation view of the supply vehicle of the present invention.

FIG. 2 shows supply vehicle 10 of train 1 which is used to supply water to milling vehicle 20 and emulsion to processing vehicle 30. Although both milling vehicle 20 and processing vehicle 30 are equipped with local storage tanks, in operation these tanks would quickly become depleted if not replenished by supply vehicle 10 and requiring train 1 to stop while tanks are refilled. Supply vehicle 10 contains two tanks: water tank 12 and emulsion tank 16. Water tank 12 is connected to milling vehicle 20 via water hose 14. Milling vehicle 20 uses the water to cool cutting drum 22 as the road surface is milled. Processing vehicle 30 also requires water and receives any required water from supply vehicle 10 indirectly through milling vehicle 20. Emulsion tank 16 is connected to processing vehicle 30 via emulsion hose 16. Emulsion is required by processing vehicle 30 as it is mixed with the aggregate removed by milling vehicle 20 to reduce the amount of time that is required to pass before traffic may pass on the road surface. By use of more than one supply vehicle train 1 may operate continuously stopping only momentarily to replace a depleted supply vehicle with a replenished supply vehicle.

Emulsion is simply a suspension of small asphalt cement droplets in water, which is assisted by an emulsifying agent. The emulsifying agent assists by imparting an electrical charge to the surface of the asphalt cement globules so that they do not coalesce. Emulsions are anionic if the asphalt cement droplets are negatively charged or cationic if the asphalt cement particles are positively charged. When the asphalt cement droplets begin to adhere to the previously milled road surface or to the road surface that remain the emulsion is said to have "broken". As water begins to evaporate, the emulsion begins to behave more and more like pure asphalt cement and once all the water has evaporated, the emulsion is said to have "set". The time required to break and set depends upon the type of emulsion, the application rate, the temperature of the surface onto which it is applied and environmental conditions. Under most circumstances, emulsion will set in about 1 to 2 hours allowing road traffic to return to normal.

FIG. 2 shows milling vehicle 20 of train 1 which uses a rotating drum containing teeth to remove the top layer of the road surface and a system of conveyors to transfer the removed road surface to processing vehicle 30. Milling vehicle 20 is operated so that the height of cutting drum 22 is fixed resulting in additional aggregate being removed from those portions of the road that are raised and less aggregate being removed from those portions of the road that are depressed with the goal of eliminating pavement distortions such as rutting, bumps, deteriorated surface material, or stripping as in where the bonding between aggregates and asphalt binder has been degraded. The aggregate is collected by processing vehicle 30 and returned to the road surface as reclaimed asphalt pavement (RAP). By reclaiming the aggregate there is no need to stockpile aggregate near a road resurfacing project site and to maintain a fleet of trucks to transport the aggregate to the project site. Milling vehicle moves forward in the direction of 20' and during milling operations forward tracks 21 will be elevated as to rear tracks 24. Forward tracks 21 may exist as a pair, one track on the left and a second track on the right side of milling vehicle 20. Rear tracks always exist as a pair, one track on the left and a second track on the right. Connection point 28 provides a hard point where processing vehicle 30 may be coupled to and towed by milling vehicle 20. Cutting drum 22, located near the center, removes the top layer of the road surface and deposits the removed asphalt onto primary conveyor 23 which is then deposited onto secondary conveyor 26 at conveyor transition area 25. Water supplied by supply vehicle 10 is used to cool cutting drum 22 and suppressing the amount dust that is generated by the milling operation. Controls for controlling milling vehicle 20 may be found in operator station 27.

Processing vehicle 30 is the third and final vehicle in train 1 and is the focus of this disclosure. The purpose of processing vehicle 30 is to reclaim the aggregate that has been removed from the road surface by milling vehicle 20 so that it may be immediately returned back onto the road surface. To achieve this purpose processing vehicle 30 will first sift the aggregate received from the milling vehicle to remove any oversized aggregate material while allowing the properly sized aggregate to be held in a hopper for subsequent use. Sifted oversized aggregate is then passed into a crusher to be reduced in size and sifted a second time. Aggregate that refuses to be reduced is collected and eventually discarded. Aggregate successfully reduced by the crusher is then placed on a conveyor and joined with the aggregate in the hopper. The conveyor transports the aggregate rearward and upwards in processing vehicle 30. At this point the aggregate on conveyor is free of oversized particles and contains a small amount of water that was introduced by milling vehicle 20 when cooling cutting drum 22. The conveyor contains a beltweigher to measure the weight of the aggregate travelling on the conveyor at a particular point on the conveyor belt. The beltweigher measurement and the speed of the conveyor are received by a computer where appropriate calculations are performed to determine the proper amount of water, cement, and emulsion that need to be added to the aggregate to satisfy the requirements of a particular recipe. Once the aggregate passes the beltweigher portion of the conveyor, cement and water is added under the control of a computer to the aggregate. The combined mix of aggregate, water, and cement travelling on the conveyor is then dropped into a pugmill where emulsion is added under the control of a computer by calculations using information provided by the beltweigher and the speed of the conveyor. The pugmill mixes the combination of aggregate, water, cement, and emulsion and deposits the resulting slurry in a spreader box that is dragged behind processing vehicle 30. Augers within the spreader box distributes the slurry equally within the spreader box to insure a uniform flow of the slurry onto the road surface. As processing vehicle 30 drags the spreader box forward, a gap between the rear side of the spreader box and the road surface allows a portion of the slurry in the spreader box to remain on the road surface. A vibrating horizontal strike plate attached to the rear side of the spreader box acts to compact any aggregate protruding from the top surface of the slurry so that the surface of the slurry is smooth.

The following paragraphs and figures discloses processing vehicle 30. Multiple figures will be used to represent processing vehicle 30 as the complexity of the vehicle demands multiple figures to clearly understand and disclose the vehicle. The figures will "build" processing vehicle 30 with each figure adding a new component of the vehicle.

Figure 4:
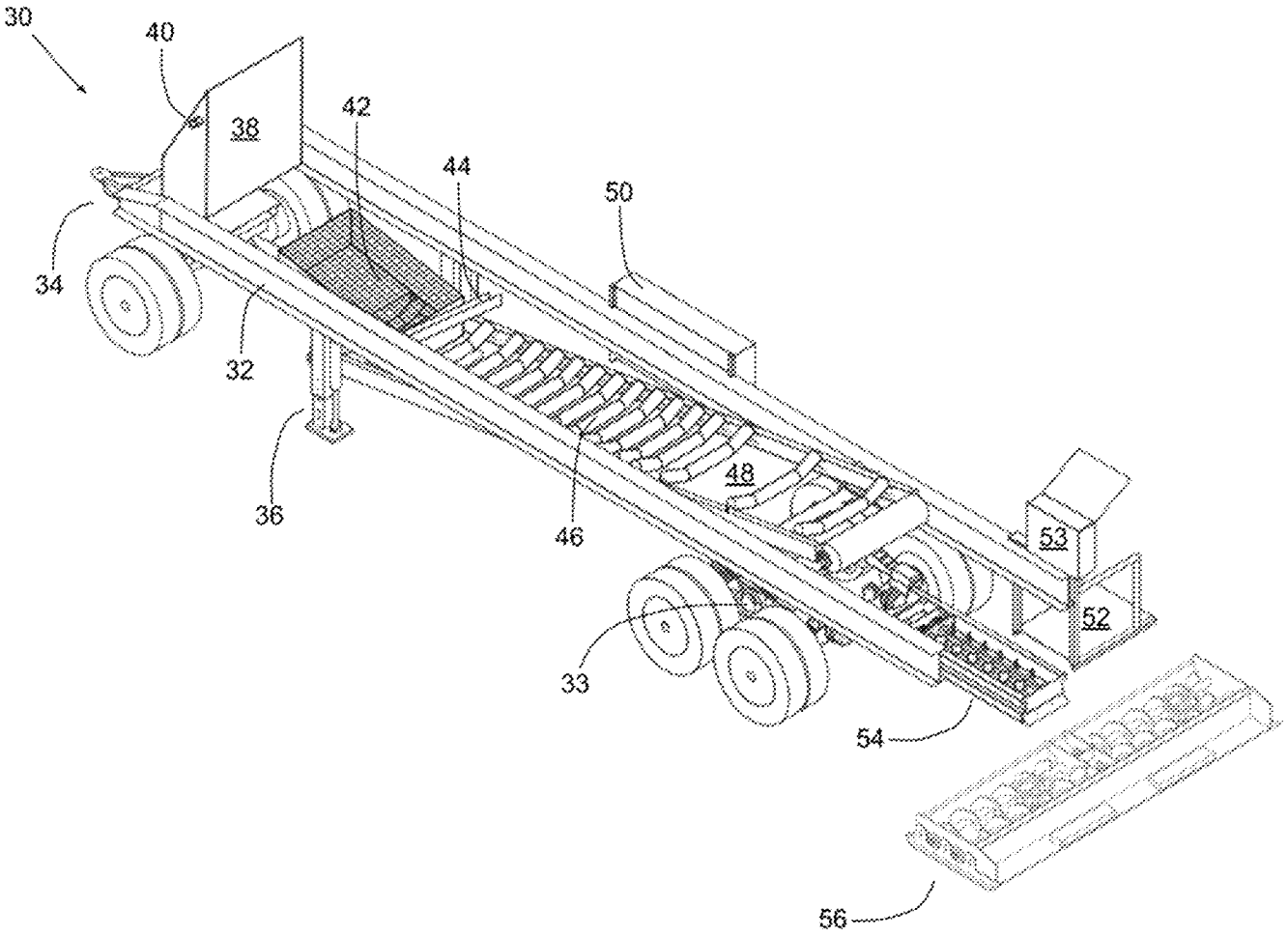
FIG. 4 shows a first perspective view of the processing vehicle of the present invention showing the chassis with the conveyor, lower screen, pugmill, and spreader box.

In FIG. 4 shows frame 32 of processing vehicle 30 and those components that astride frame 32 or attached to it. Frame 32 is comprised of two elongated I-beams that travel the length of processing vehicle 30 with the I-beams positioned at the left and right side of processing vehicle 30. Dolly 34 is attachable to the front of processing vehicle 30 allowing it to be towed when being transported from one location to another. When connected to milling vehicle 20, dolly 34 is replaced by another structure, not shown, that allows processing vehicle 30 to be connected to and towed by milling vehicle 20 at connection point 28. Support jacks 36, attached to each of frames 32 may be lowered to support the front end when processing vehicle 30 is in storage as well as to lift the front end of processing vehicle 30 when detaching or reattaching dolly 34 or other such structure. To the rear of frame 32 is found rear wheel assembly 33 containing; among other mechanisms such as breaks, springs, and axles to support the rear wheels; a measuring wheel connected to a shaft encoder. When processing vehicle 30 is in operation, the measuring wheel is positioned to make contact with a rear wheel and so caused to be rotated as processing vehicle 30 moves. As the measuring wheel turns, the shaft encoder creates pulses at a rate proportional to the rotational speed of the measuring wheel. These pulses are then analyzed by computer 53 to determine the speed of processing vehicle 30. When processing vehicle 30 is not in operation the measuring wheel is retracted from the rear wheel. Mounted at the front of processing vehicle 30 is water tank 38 which is used to supply water, by means of a pump, at various points for the purpose of reducing dust that is created while reclaiming the aggregate and creating the resultant slurry. The water that is to be added to the resultant slurry passes through an electromagnetic flowmeter prior to flowing into pugmill 54. The electromagnetic flowmeter measures the volume of water that is flowing into pugmill 54 and sends this information to computer 53. Computer 53 may then adjust the pressure of the pump to decrease or increase the flow of water into pugmill 54 as specified by the selected recipe. Water tank 38 contains water input port 40 to receive water from supply vehicle 10 indirectly through milling vehicle 20. Lower screen 42 is found behind water tank 38 and receives aggregate that has been reduced in size by crusher 58. Lower screen 42 vibrates by means of an electrical motor so that only aggregate that is of an appropriate size or smaller may pass through the screen and onto conveyor 46. Aggregate that remain oversized even after passing through crusher 58 fall into rejection chute 44 to be collected and discarded. Conveyor 46 is positioned between left and right frames 32 and extends along the longitudinal axis of processing vehicle 30 moving material, mostly aggregate, rearwards in an upward slope. A shaft encoder is attached to the first roller at the forward end of conveyor 46 and as the roller turns, the shaft encoder creates a series of pulses at a rate proportional to the rotational speed of the roller. These pulses are then analyzed by computer 53 to determine the speed of the conveyor belt. Conveyor 46 receives at a first station oversized aggregate that has been reduced by crusher 58 and passed through lower screen 42, at a second station aggregate that passes through upper screen 66 and through hopper 62, and at a third station cement from cement tank 64. Finally, at the end of the belt, the combination of aggregate and cement is deposited into pugmill 54. Between the previously mentioned second and third station conveyor 46 contains beltweigher 48. A beltweigher is a piece of industrial control equipment used to measure the amount of material travelling over a section of a conveyor by replacing or modifying one or more support rollers underneath the conveyor with load cells to measure the weight of the material at that point. The weight measured by the load cells is integrated with the speed of the belt to compute the weight of aggregate moving on the belt, after allowing for the weight of the belt itself. The weight measured by beltweigher 48 is sent to computer 53 found at operator station 52 to calculate the amount of cement, water, and emulsion that is needed to be added to the aggregate to satisfy a preprogrammed recipe so that the aggregate is suitable to be returned to the road surface. Cement is added at the previously mentioned third station by cement tank 64 while emulsion is pumped into pugmill 54 where the aggregate, water, cement, and emulsion are mixed together into a slurry. The slurry is then poured into spreader box 56 where it is laid onto the road surface. Electrical distribution box 50 distributes electrical energy from generator 78 to the various electrical components found in processing vehicle 30. Operator station 52 contains a touch screen panel along with other manual controls that allows the operator to enter a preprogrammed recipe, select manual overrides, and/or alter the attributes of the various subsystems installed on processing vehicle 30.

Figure 5:
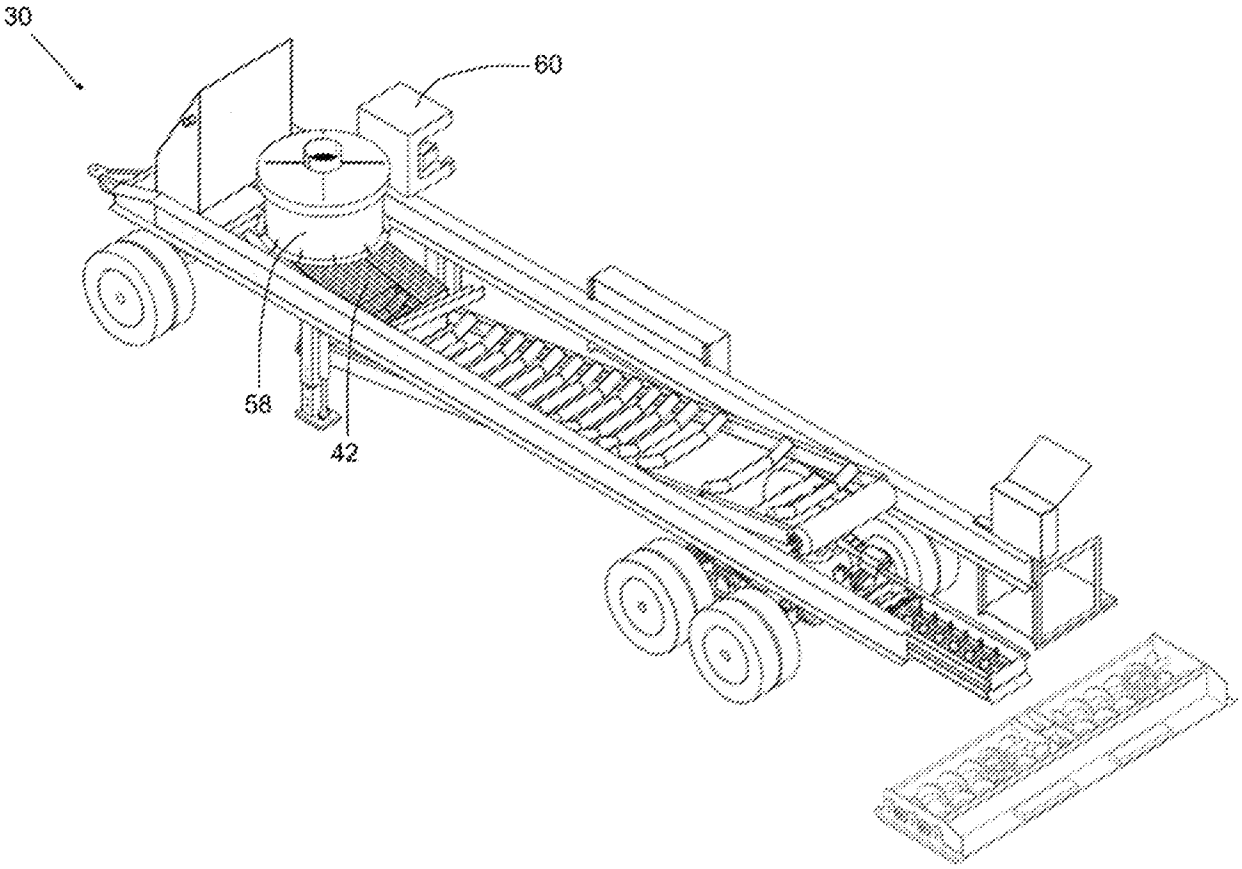
FIG. 5 shows a second perspective view of the processing vehicle of the present invention showing the components of FIG. 4 plus the crusher.

FIG. 5 shows processing vehicle 30 with the components shown in FIG. 4 and additionally crusher 58 that is used for reducing oversized aggregate received from upper screen 66. Crusher 58 is a vertical shaft impact crusher whereby aggregate to be reduced in size is poured into the opening shown atop of crusher 58 while crushed aggregate falls below crusher 58 and onto lower screen 42. A vertical shaft impact crusher functions by receiving aggregate that is to be reduced through an opening at the top of the crusher where the aggregate then descends into the crusher and is received by an impeller that is rotating at 1,000 revolutions per minute or higher. The high rotational speed of the impeller causes the aggregate to be catapulted at high velocities away from the center of the crusher and striking either the outer wall or other aggregate travelling within the crusher causing the aggregate to break apart. Aggregate eventually falls through an opening at the bottom of the crusher where it may be collected and used. In the case of processing vehicle 30, pieces of aggregate may be too large to be properly mixed with cement and emulsion and reused. These oversized pieces of aggregate may be reduced in size by crusher 58 so that it may be properly mixed with cement and emulsion and reused. Crusher 58 is operated by an electrical motor contained within crusher motor box 60. In addition to the electrical motor, crusher motor box 60 holds a hydraulic lift to assist in lifting the lid of crusher 58 for maintenance.

Figure 6:
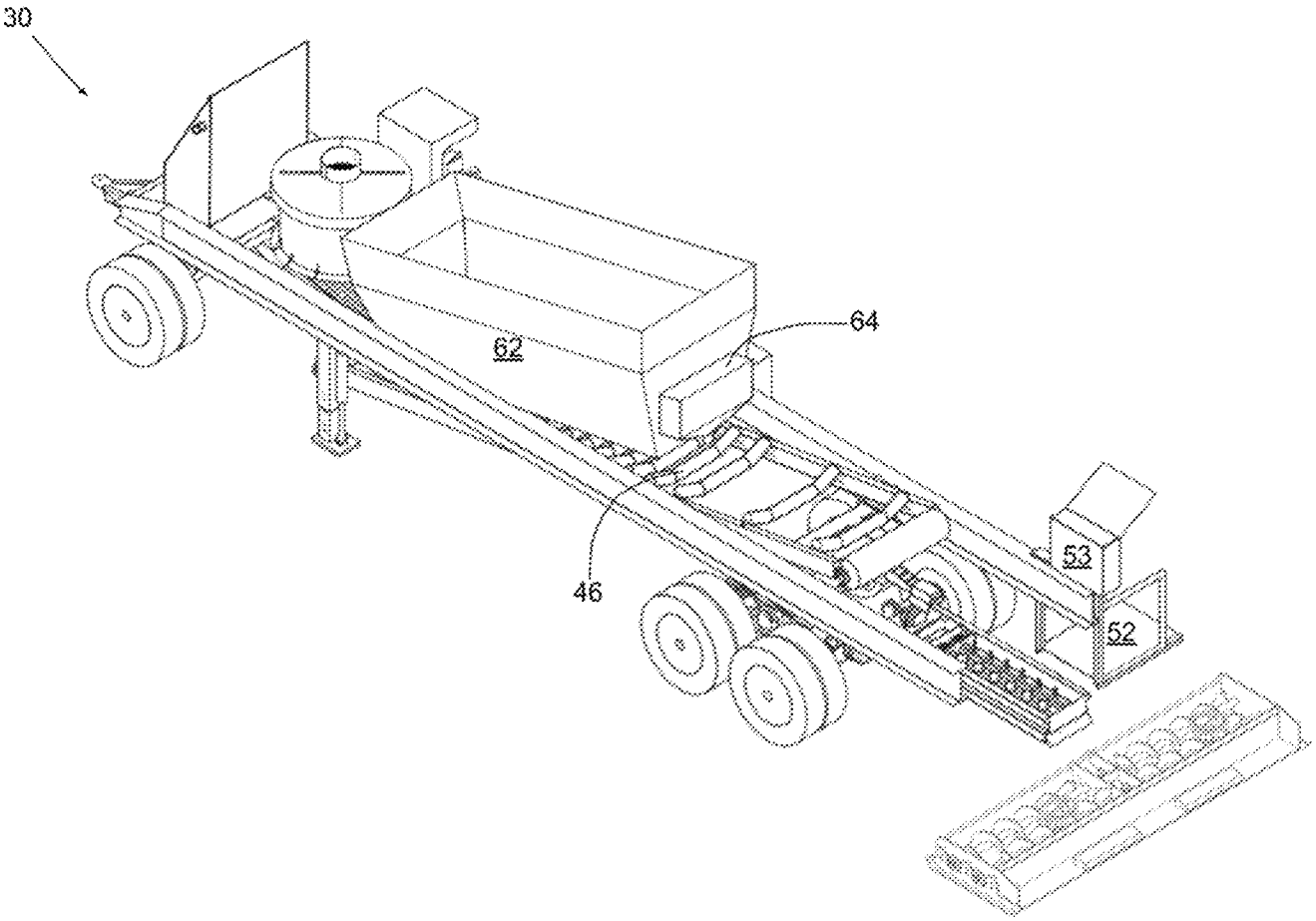
FIG. 6 shows a third perspective view of the processing vehicle of the present invention showing the components of FIG. 5 plus the hopper and cement tank.

FIG. 6 shows processing vehicle 30 with the components shown in FIG. 5 and additionally hopper 62 and cement tank 64. The height of a length of road surface to be operated on by a milling vehicle will be uneven with some lengths of road surface being higher than others. During operation, milling vehicle 20 removes the top portion of the road surface by first rotating its cutting drum at a certain rotational speed and then vertically positioning the cutting drum into the road surface so that the proper amount of road surface is removed. As the milling vehicle moves forward the cutting drum maintains its vertical position in order to provide an even and smooth surface for traffic to travel upon. Due to variations in the road surface height, the amount of road surface removed as aggregate varies from road length to road length yet the amount of slurry to be deposited back onto the road surface will remain constant. To make sure that processing vehicle 30 has sufficient aggregate to provide a constant output of slurry, excess aggregate removed by milling vehicle 20 within those road lengths where the road surface is higher, is stored in hopper 62 to be used when the amount of aggregate being received from milling vehicle 20 is reduced. In addition to hopper 62, FIG. 6 shows cement tank 64 mounted to the rear of hopper 62 and above conveyor 46. Adding cement as a filler to the aggregate improves the resulting slurry by reducing the break time and giving the slurry a creamy consistency that aids in even spreading. A rotary feeder that is controlled by computer 53 at operator station 52 is mounted below cement tank 64 and deposits a controlled amount of cement onto the aggregate passing below it on conveyor 46. A magnetic sensor attached to the rotary feeder creates a waveform as the rotary feeder turns. By analyzing this waveform, computer 53 may calculate the amount of cement that is being deposited onto the aggregate and thereby adjust the speed of the rotary feeder appropriately.

Figure 7:
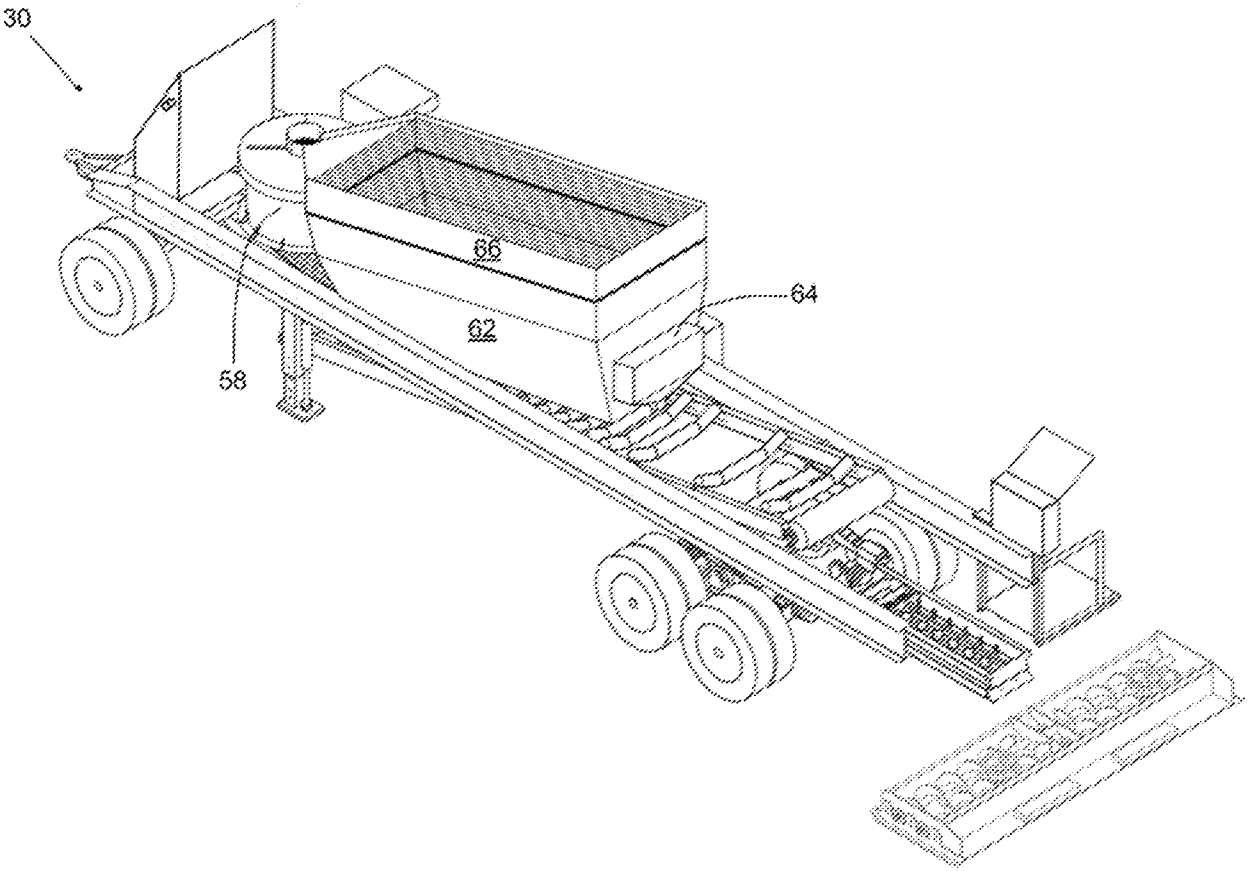
FIG. 7 shows a fourth perspective view of the processing vehicle of the present invention showing the components of FIG. 6 plus the upper screen.

FIG. 7 shows processing vehicle 30 with the components shown in FIG. 6 and additionally upper screen 66. Upper screen 66 receives aggregate milled by milling vehicle 20 via secondary conveyor 26 and is mounted to the top of hopper 62 at an incline so that the forward end of upper screen 66 is lower than the rearward end. Aggregate received from milling vehicle 20 that are able to fall through the screen pass into hopper 62 while oversized aggregate roll downwards towards the forward end of upper screen 66 and are funneled into crusher 58 to be reduced in size. An electric motor is attached to upper screen 66 causing it to vibrate to facilitate the process of separating the oversized aggregate from those that are not oversized.

Figure 8:
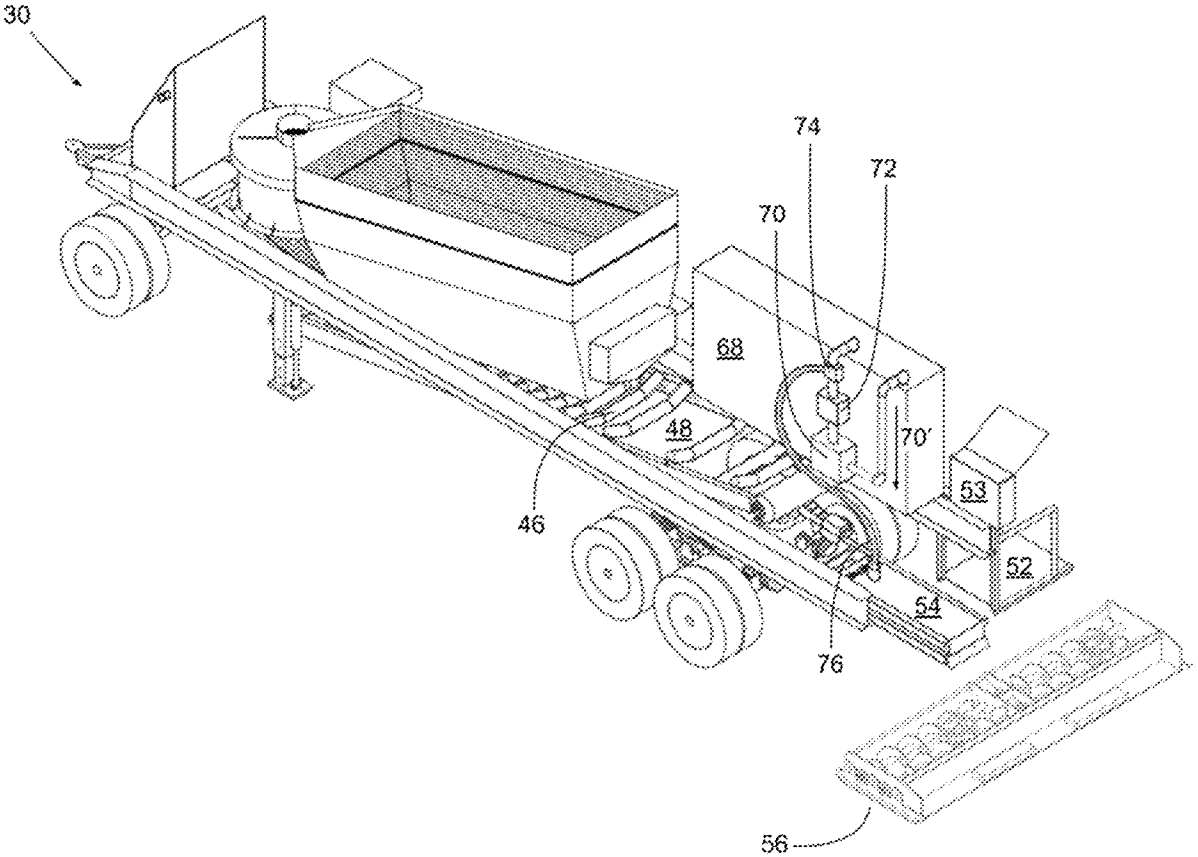
FIG. 8 shows a fourth perspective view of the processing vehicle of the present invention showing the components of FIG. 7 plus the asphalt emulsion tank.

FIG. 8 shows processing vehicle 30 with the components shown in FIG. 7 and additionally emulsion tank 68 and related components. As aggregate is transported rearward by conveyor 46, the weight of the aggregate is measured by beltweigher 48. This weight, along with the speed of conveyor 46, is received by computer 53 at operator station 52 where calculations are performed according to the selected recipe to determine the amount of emulsion, along with cement and water, that is to be added to the aggregate. Computer 53 will then compare the calculated amount of emulsion to be added to actual amount of emulsion that is passing through mass flow meter 72 and make the necessary adjustments to pump 70 so that the values match. Mass flow meter 72 makes use of the Coriolis effect to accurately measure the weight and density of the emulsion that passes through the meter regardless of the emulsion's temperature or the ambient pressure on the emulsion. When processing vehicle 30 is in operation but not reclaiming aggregate, that is in a standby mode, the binding agent in the emulsion separates from other elements resulting in uneven break times at best or in slurry that is returned to the road surface without any binding agent to adhere together or to the road surface. To prevent the separation of the binding agent from the other elements the emulsion must be circulated even while processing vehicle 30 is in standby mode. While processing vehicle 30 is in standby mode valve 74 may be set to direct the flow of emulsion back into emulsion tank 68 to keep the binding agent in suspension and uniformly distributed within emulsion tank 68. During operation valve 74 may be set to direct the flow of emulsion to pugmill 54 via hose 76 where it will be mixed with the aggregate and cement present. Valve 74 may also be set to block the flow of emulsion. Pugmill 54 uses an arrangement of paddles on two rotating shafts to mix the aggregate, water, cement, and emulsion together into a slurry and to push the resulting slurry onto spreader box 56. The rotational speed of the shafts may vary according to the recipe that has been selected by the operator. Lower rotational speeds allow for a greater degree of mixing while higher rotational speeds reduce the amount of time spent mixing. To ensure that the shafts are rotating at the speed called for by the recipe, a magnetic sensor is used that generates electrical pulses according to the rotational speed of the shafts. Computer 53 receives these pulses and uses this information to adjust the speed of the shaft to the speed called for by the recipe.

Figure 9:
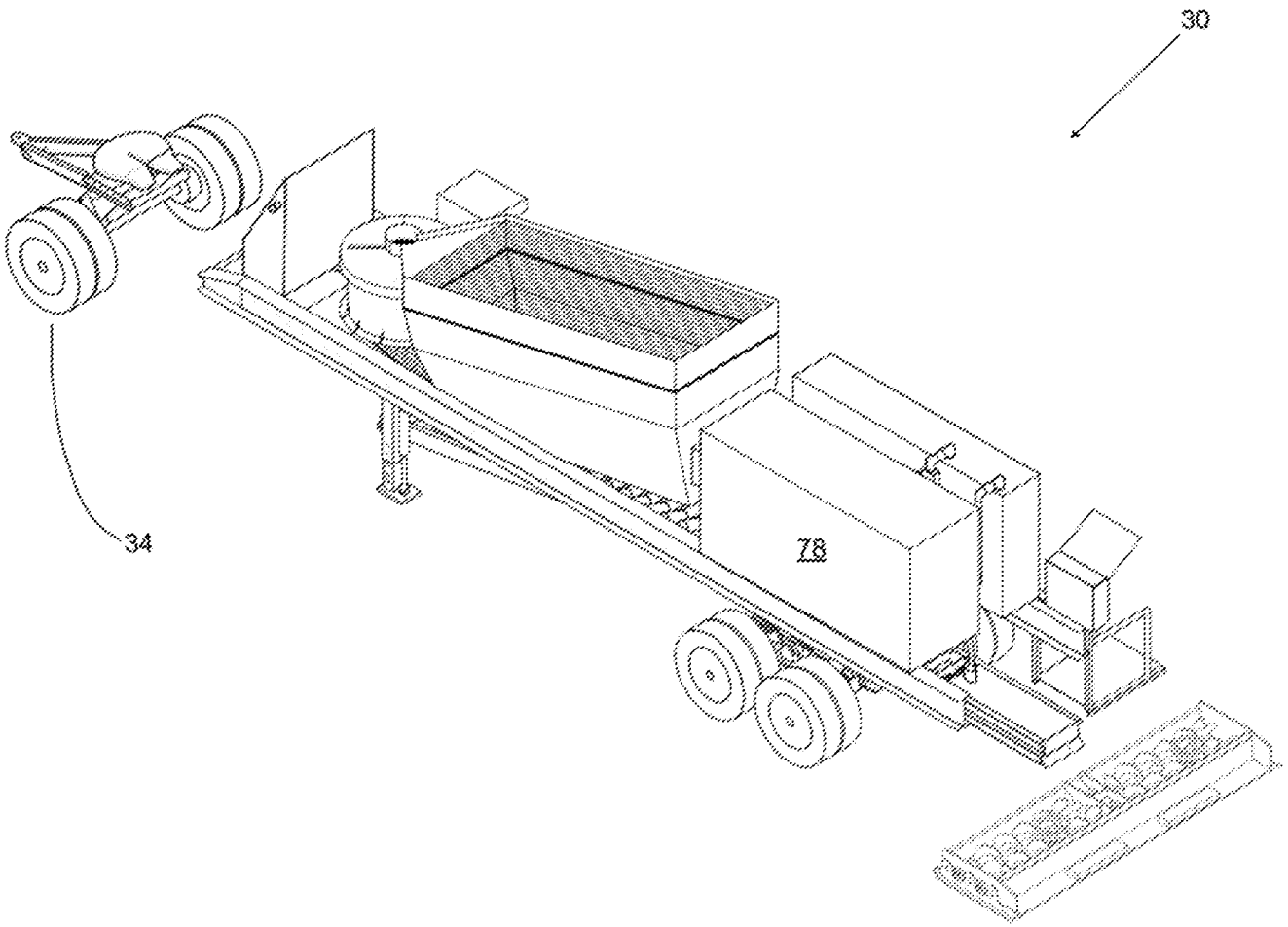
FIG. 9 shows a fourth perspective view of the processing vehicle of the present invention showing the components of FIG. 8 plus the generator.

FIG. 9 shows processing vehicle 30 with the components shown in FIG. 8 and additionally generator 78 which is used to convert diesel fuel to electrical energy. The electrical energy provided by generator 78 is used to operate the various motors and electrical components required for reclaiming the road surface asphalt. Also shown in FIG. 9 is the detachment of dolly 34 from processing vehicle 30. When connected to milling vehicle 20, dolly 34 is replaced by another structure, not shown, that allows processing vehicle 30 to be connected to and towed by milling vehicle 20 at connection point 28. During transport processing vehicle 30 may be towed without dolly 34 by means of a fifth-wheel coupling means or by traditional trailer hitch means when using dolly 34.

Figure 10:
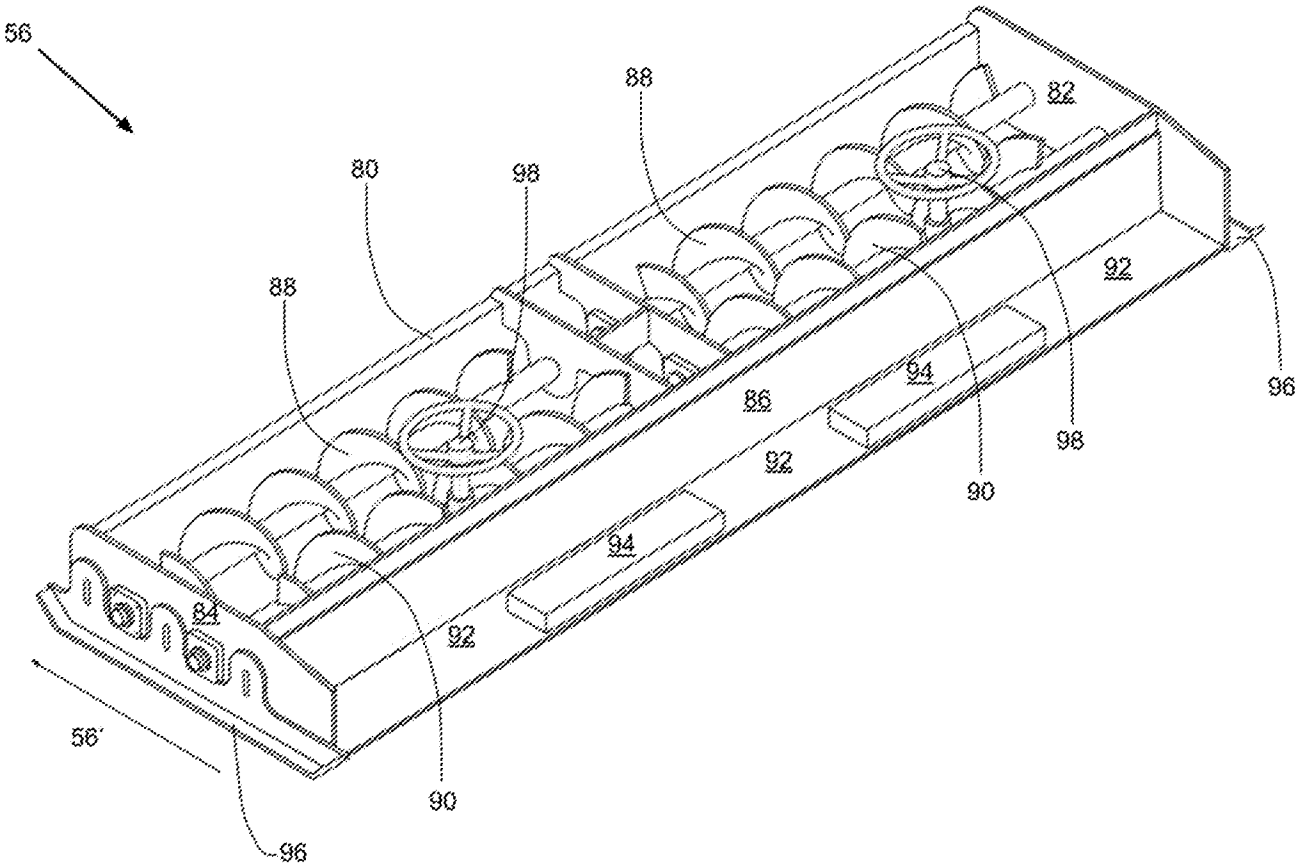
FIG. 10 shows a perspective view of the spreader box attached to the processing vehicle of the present invention.

FIG. 10 shows a detail view of spreader box 56 that is dragged by processing vehicle 30 while in operation. Spreader box 56 is used to receive slurry from pugmill 54 and evenly distribute the slurry over the road surface where the aggregate that comprises the slurry was previously removed from the road surface by milling vehicle 20. It is rectangular in shape with front 80, left 84, right 82, and rear 86 side, being open at the bottom and the top, and moved in the direction indicated by 56'. Spreader box 56, while in operation, is lifted to a set height above the road surface by skid rails 96 as adjusted by hand jacks 98. Rubber curtains, not shown, attached to front 80, left 84, and right 82 sides encourage the flow of slurry out through the gap that exists between rear side 86 and the road surface. As aggregates may be protrude above the surface of the slurry when exiting the rear of spreader box 56, it is necessary to compact these aggregates to create a smooth road surface. A number of means are used by spreader box 56 to eliminate the presence of aggregates protruding above the surface of the slurry as the slurry leaves spreader box 56. A first means is to fabricate spreader box 56 with hardened metal plates so as to be heavier and compact the aggregates protruding above the surface of the slurry. A second means is to utilize strike plate 92; made of harden metal, being heavy, attached to the lower edge of rear side 86 and along its entire length, and of a sufficient width; to break up or compact the aggregates protruding above the surface of the slurry. A third means is to install vibrators 94 to strike plate 92 thereby encouraging the settling of aggregates within the slurry by the vibrations emanating through strike plate 92. As a result of these foregoing means the resulting road surface will be smooth.

Figure 11:
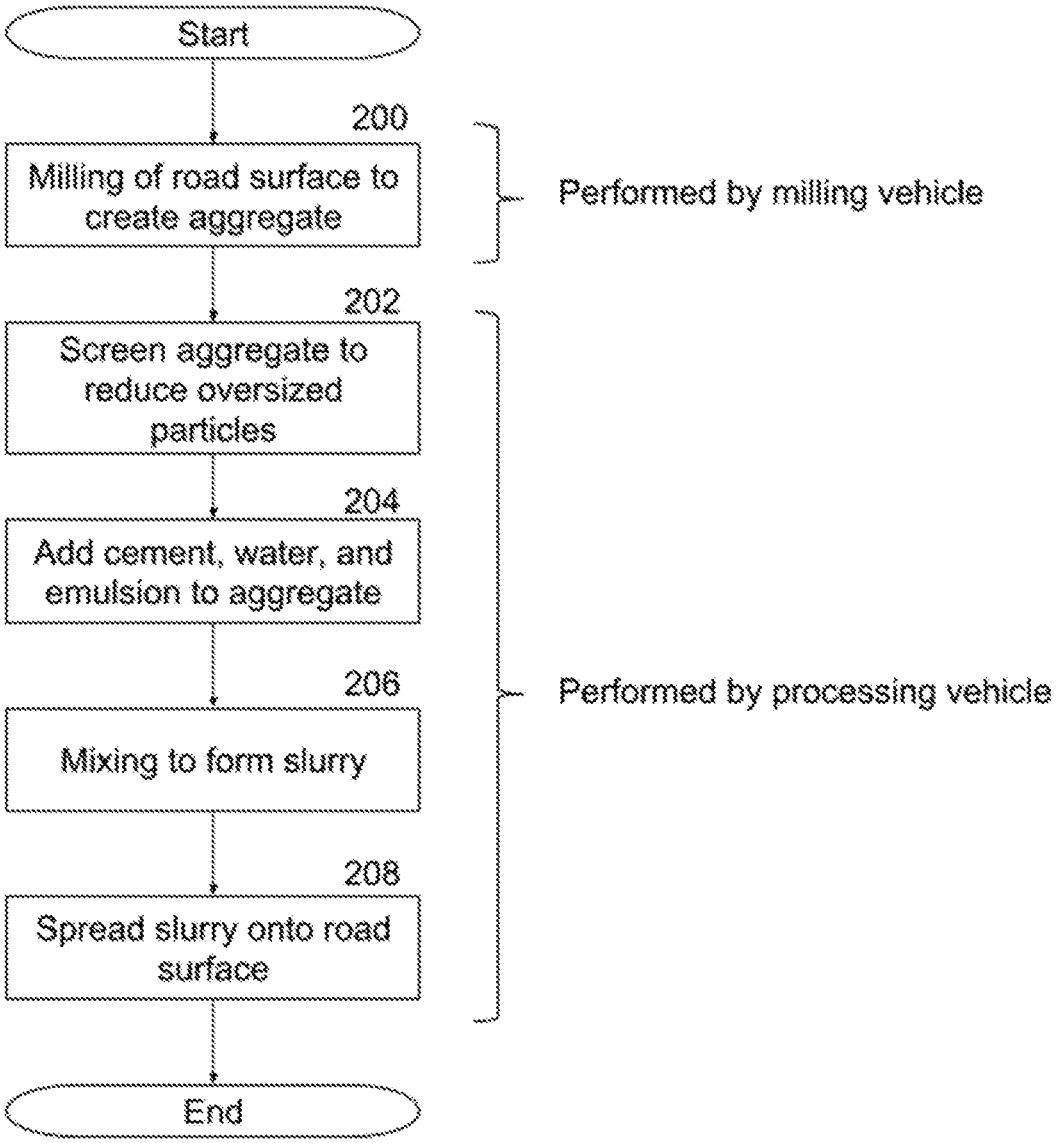
FIG. 11 shows a flowchart of the process to reclaim road surface asphalt as a slurry to replace the road surface that was previously milled.

FIG. 11 shows a flowchart of the process being disclosed. The process starts with step 200 where the top portion of the road surface is milled, or grounded, from the road surface by a cutting drum that is controlled by milling vehicle 20. The road surface that is milled becomes aggregate and is transported by a system of conveyors to processing vehicle 30. In step 202 the aggregate milled by milling vehicle must be inspected for the presence of oversized aggregate. This is done by a vibrating screen set at an incline so that oversized aggregate rolls downward into a crusher where the oversized aggregate is reduced in size and inspected again. If the aggregate remains oversized it is discarded, otherwise the aggregate is rejoined with the aggregate that passed the first inspection and made available to be reclaimed. In step 204 cement, water, and emulsion are added to the aggregate according to a recipe to allow the aggregate to be reused as a road surface. The addition of cement, water, and emulsion to the aggregate are controlled by computer 53 with feedback being provided by a variety of sensors. In step 206 the cement, water, emulsion, and aggregate are mixed together to form a slurry that conforms to a previously entered recipe. Finally, in step 208, the slurry is spread onto the road surface that was previously milled in step 200.

Figure 12:
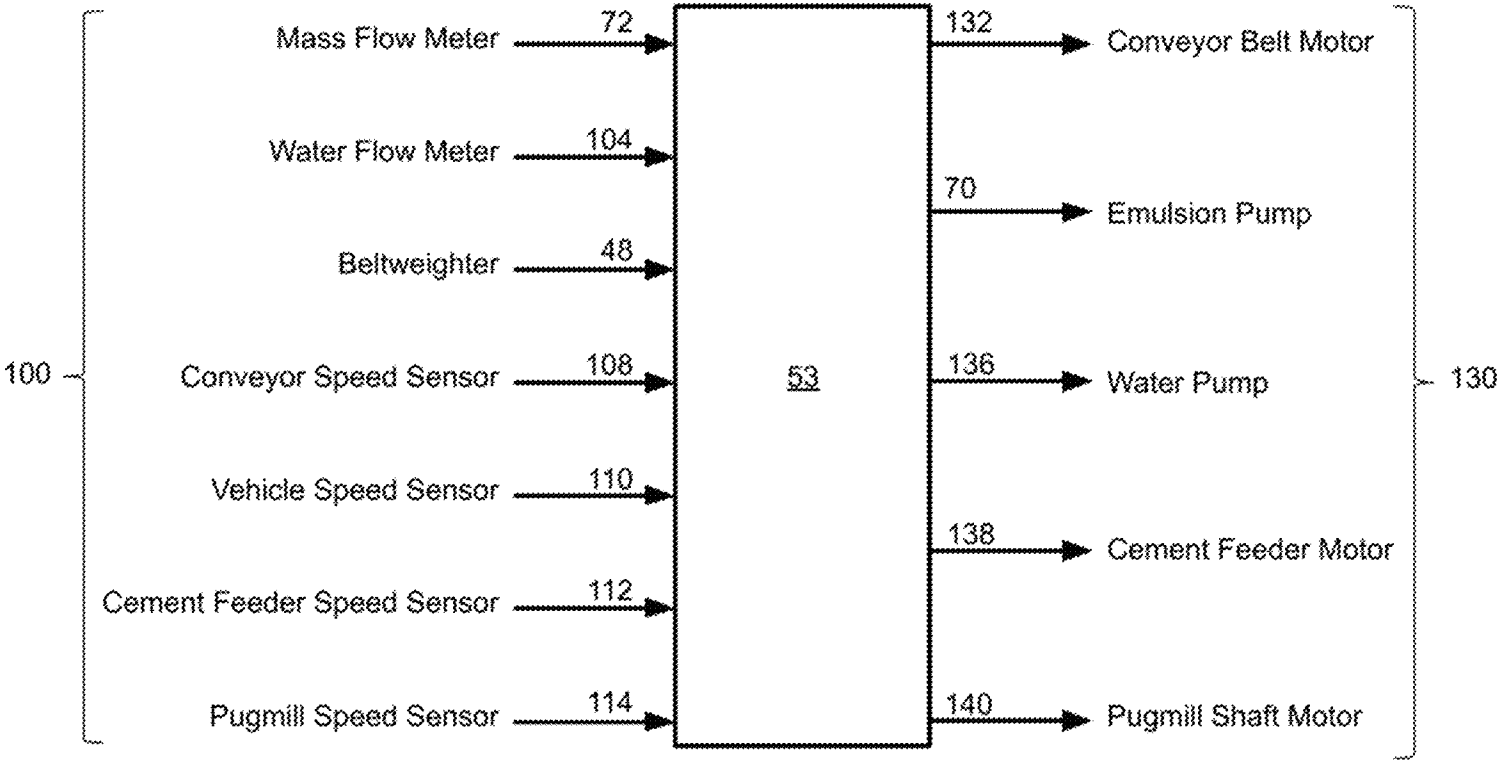
FIG. 12 shows a chart displaying inputs that are monitored by the computer and outputs that are controlled by the computer.

FIG. 12 shows inputs 100 from sensors and meters that are monitored and processed by computer 53 and outputs 130 from computer 53 to those motors and pumps that act on the aggregate to create the slurry. A key component of processing vehicle 30 is conveyor 46 as it transports aggregate taken from the road surface by milling vehicle 20 from the front of processing vehicle 30 where crusher 58 and lower screen 42 are found, past hopper 62 and cement tank 64, and into pugmill 54 found at the rear of processing vehicle 30. However, the amount of aggregate being transported by conveyor 46 varies depending upon the height of the road surface being removed by cutting drum 22, the speed of processing vehicle 30, and to some degree the amount of oversize aggregate being diverted from hopper 62 into crusher 58 by upper screen 66. To compensate for this, various sensors are used throughout processing vehicle 30 as inputs 100 into computer 53 in order to properly control various pumps and motors as outputs 130.

To dispense the correct amount of cement to the aggregate as it passes under cement tank 64, computer 53 must know the weight of the aggregate that is passing underneath cement tank 64 and the actual amount of cement that is being dispensed. Computer 53 is able to determine the weight of aggregate passing underneath cement tank 64 by measuring the weight of the aggregate where beltweigher 48 is found and then determining the amount of time it takes for the aggregate to travel from the beltweigher 48 to cement tank 64 using conveyor speed sensor 108. As the aggregate approaches cement tank 64, computer 53 will adjust the speed of cement feeder motor 138 to the speed called for by the selected recipe by reading and processing the signal sent by cement feeder speed sensor 112. Thus, the correct amount of cement may be dispensed onto the aggregate regardless of the amount of aggregate present on, or the speed of, conveyor 46.

To dispense the correct amount of water to the mixture of aggregate and cement as it flows into pugmill 54 from conveyor 46, computer 53 must know the combined weight of the mixture, when the mixture will be received by pugmill 54, and the actual amount of water that was dispensed. Computer 53 is able to determine the weight of the mixture by measuring the weight of the aggregate where beltweigher 48 is found and the amount of cement that was added to the aggregate by cement feeder speed sensor 112. In addition, computer 53 is able to determine when the aggregate and cement mix will flow into pugmill 54 by measuring the speed of conveyer 46 using conveyor belt speed sensor 108. With this information, computer 53 will be able to calculate from the selected recipe the amount of water to be added and appropriately raise or lower the rate of water pump 136. Water flow meter 104 measures the flow from water pump 136 allowing computer 53 to accurately set the amount of water being dispensed into pugmill 54.

To dispense the correct amount of emulsion to the mixture of aggregate, cement, and water in pugmill 54, computer 53 must know the combined weight of the aggregate and cement, when the aggregate and cement will be received by pugmill 54, and the actual amount of water that has been added to the aggregate and cement. Computer 53 is able to determine the weight of the aggregate using beltweigher 48, the amount of cement that was added to the aggregate by cement feeder speed sensor 112, and the amount of water added to pugmill 54 by water flow meter 104. With this information, computer 53 will be able to calculate from the selected recipe the amount of emulsion to be added and appropriately raise or lower the rate of emulsion pump 70. Mass flow meter 72 measures the output of emulsion pump 70 allowing computer 53 to accurately set the amount of emulsion being dispensed into pugmill 54.

The speed that processing vehicle 30 is traveling at is measured by vehicle speed sensor 110 found as part of rear wheel assembly 33. As the speed of processing vehicle 30 increases, the need for additional slurry will increase. In similar manner, as the speed of processing vehicle 30 decreases, the need for slurry will decrease. Computer 53 receives from vehicle speed sensor 110 the speed at which processing vehicle 30 is moving at and increases or decreases the production of slurry by adjusting the speed of conveyor belt 46. By changing the rate of conveyor belt motor 132, computer 53 may control the amount of aggregate used to source the creation of slurry.

Pugmill 54 contains paddles to mix the combination of aggregate, cement, water, and emulsion. At times the combination may require more time in pugmill 54 to achieve the proper level of mixing. Computer 53 may control the amount of time the combination remains in pugmill 54 by changing the rate of pugmill shaft motor 140. The faster the shafts are turned the less time the combination remains in pugmill 54. To measure the rate at which the shafts are turning, computer 53 monitors the signal sent by pugmill speed sensor 114.

What is claimed is:

1. A processing vehicle adapted to be towed along a roadway to receive milled road surface from a milling vehicle as aggregate, perform a first screening of said aggregate for oversized aggregate, crushing said oversized aggregate as crushed aggregate, perform a second screening of said crushed aggregate to discard remaining oversized aggregate, combine said aggregate and said crushed aggregate passing through said first and second screenings as combined aggregate, weighing said combined aggregate, mixing said combined aggregate with a measured amount of water, Portland cement ("cement"), and asphalt emulsion determined from the weight of said combined aggregate as slurry, and distributing said slurry onto said milled road surface said processing vehicle comprising:

an elongated frame;

a dolly comprising an axle, one or more pneumatic wheels at either end of the axle, towing hitch releasably coupled to said milling vehicle for towing said processing vehicle, and a coupling component to be releasably coupled to a forward end of said frame;

a rear wheel assembly consisting of one or more axles each with one or more pneumatic wheels at either end of the axles the assembly mounted towards a rearward end of said frame;

a hopper carried by said frame and positioned forwardly within said frame to receive said aggregate;

a crusher to reduce oversized aggregate being positioned forwardly of said hopper;

a water tank;

a cement tank;

an asphalt emulsion tank;

a conveyor belt operating lengthwise within said frame to transport aggregate received from said crusher and said hopper rearwardly;

a beltweigher within said conveyor belt to weigh said aggregate being transported;

a first screen having a vibrating action, positioned above said hopper to receive said aggregate, allowing non-oversized aggregate to be received by said hopper, and inclined to channel oversized aggregate to said crusher;

a second screen having a vibrating action, positioned below said crusher to receive crushed aggregate, allowing non-oversized aggregate to be received by said conveyor belt, and inclined to cause oversized aggregate to be discarded;

a pump to add water from said water tank to said aggregate;

a motor to add cement from said cement tank to said aggregate;

a pump to add asphalt emulsion from said asphalt emulsion tank to said aggregate;

a pugmill to receive and mix said aggregate, water, cement, and asphalt emulsion into a slurry;

a spreader box to distribute said slurry onto the road surface the spreader box comprising:

a rectangular structure having a front, back, left, and right sides;

a skid rail attached to the left side and a skid rail attach to the right side to lift said rectangular structure above the road surface;

a rubber curtain occupying the gap between the front, left, and right sides of said rectangular structure and the road surface;

a plurality of augers within said rectangular structure to distribute said slurry within said rectangular structure; and a strike plate of metal construction attached to bottom and lengthwise of said back side of said rectangular structure having a width of at least four inches;

a generator to convert diesel fuel into electricity to supply the electrical needs of said processing vehicle; and a computer to monitor a plurality of sensors and control said processing vehicle.

2. The processing vehicle of claim 1 wherein said frame having support jacks mounted forwardly of said frame to support said frame during storage or when changing said dolly.

3. The processing vehicle of claim 1 wherein the height of said skid rails are adjustable.

4. The processing vehicle of claim 1 wherein said crusher is a vertical shaft impactor with variable speed drive, and hydraulic opening.

5. The steerable front wheel means of claim 1 further comprising means to be releaseably coupled with said frame.

6. The processing vehicle of claim 1 wherein the speed of the conveyor belt is sensed and controlled by said computer.

7. The processing vehicle of claim 1 wherein the rate of water being pumped is sensed and controlled by said computer.

8. The processing vehicle of claim 1 wherein the rate of cement being added is sensed and controlled by said computer.

9. The processing vehicle of claim 1 wherein the rate of asphalt emulsion being pumped is sensed and controlled by said computer.

* * * * *